US007571898B2

(12) United States Patent
Higgs et al.

(10) Patent No.: US 7,571,898 B2
(45) **Date of Patent: *Aug. 11, 2009**

(54) COUNTER-BALANCE WEIGHT FOR A MODULAR SAFETY RAIL

(75) Inventors: Philip Maurice Higgs, Berkshire (GB); Charles William Stratford Presant, Berkshire (GB); Francis Donald Tegg, Berkshire (GB)

(73) Assignee: Kee Klamp Limited, Reading (GB)

( * ) Notice: Subject to any disclaimer, the term of this patent is extended or adjusted under 35 U.S.C. 154(b) by 491 days.

This patent is subject to a terminal disclaimer.

(21) Appl. No.: 11/098,519

(22) Filed: Apr. 5, 2005

(65) Prior Publication Data

US 2006/0113516 A1 Jun. 1, 2006

Related U.S. Application Data

(63) Continuation-in-part of application No. 10/287,480, filed on Nov. 5, 2002, now Pat. No. 6,942,199.

(30) Foreign Application Priority Data

Nov. 8, 2001 (GB) ..... 0126859.8

(51) Int. Cl.
*E04H 17/22* (2006.01)

(52) U.S. Cl. ..... 256/65.14; 256/1; 256/19; 256/59; 16/400

(58) Field of Classification Search ..... 256/65.14, 256/59, 1, 19, 65.01, 65.02, 63, 64, 30, 31, 256/35, 36; 248/316.1, 231.21; 16/400
See application file for complete search history.

(56) References Cited

U.S. PATENT DOCUMENTS 531,027 A 12/1894 Gist
3,245,181 A * 4/1966 Stephenson ..... 256/59
3,805,439 A 4/1974 Krengel et al.
4,037,668 A 7/1977 Svejda
D252,976 S * 9/1979 Hanson et al. ..... D8/396
4,532,731 A 8/1985 Wheeler
4,647,042 A 3/1987 Bruce
4,865,288 A * 9/1989 Dicke et al. ..... 248/576
4,884,306 A * 12/1989 Goetz ..... 5/503.1

(Continued)

FOREIGN PATENT DOCUMENTS

CA 1 002 410 12/1976

(Continued)

*Primary Examiner*—Daniel P Stodola
*Assistant Examiner*—Nahid Amiri
(74) *Attorney, Agent, or Firm*—Young & Thompson

(57) ABSTRACT

A counter-balance weight for a modular safety rail includes a solid body of a compact shape which defines a substantially planar major surface which, in use, is intended to rest on a support surface The body defines a substantially linear through-bore for receiving an end of a spacer member. The through-bore extends continuously through the body in a direction substantially parallel with the substantially planar major surface of the body. The through-bore extends between a pair of end faces which, at least in part, are non-parallel end faces and the body further defines a screw-threaded aperture which extends through the body to intersect and communicate with the through-bore. The body may have a substantially triangular shape in transverse cross-section.

30 Claims, 12 Drawing Sheets

U.S. PATENT DOCUMENTS

| | | | | | |
|---|---|---|---|---|---|
| 5,060,904 | A | * | 10/1991 | Hegarty | 248/454 |
| 5,131,183 | A | | 7/1992 | Thayer et al. | |
| 5,145,153 | A | | 9/1992 | Glynn | |
| 5,149,188 | A | * | 9/1992 | Robbins | 362/183 |
| 5,188,342 | A | | 2/1993 | Ouellette | |
| 5,189,828 | A | | 3/1993 | Summers | |
| 5,237,768 | A | * | 8/1993 | Kiekhafer et al. | 43/4.5 |
| 5,348,291 | A | * | 9/1994 | Scully | 473/454 |
| 5,676,350 | A | * | 10/1997 | Galli et al. | 256/13.1 |
| 6,161,326 | A | | 12/2000 | Ratte | |
| 6,257,559 | B1 | * | 7/2001 | Mouri | 256/26 |
| 6,276,869 | B1 | | 8/2001 | Yakushinji | |
| 6,676,112 | B2 | * | 1/2004 | Dorr | 254/323 |
| 7,093,322 | B2 | * | 8/2006 | Townend | 16/400 |
| 2001/0006231 | A1 | | 7/2001 | McCracken | |

FOREIGN PATENT DOCUMENTS

| | | | |
|---|---|---|---|
| DE | 38 03 211 | | 8/1989 |
| DE | 286 198 | | 1/1991 |
| DE | 297 00 951 | | 4/1997 |
| DE | 200 18 960 | U1 | 1/2001 |
| EP | 0 288 100 | | 10/1988 |
| EP | 1 209 303 | A2 | 5/2002 |
| FR | 2737524 | A1 * | 2/1997 |
| GB | 2 360 531 | | 9/2001 |

* cited by examiner

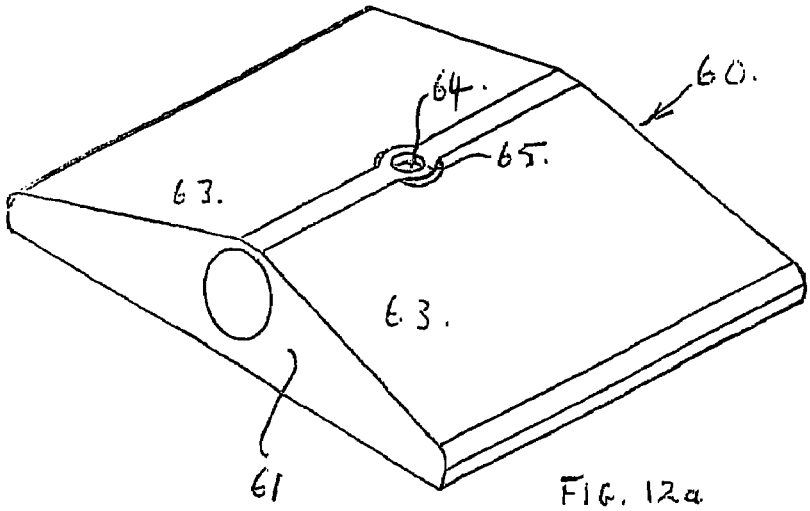
FIG. 12a
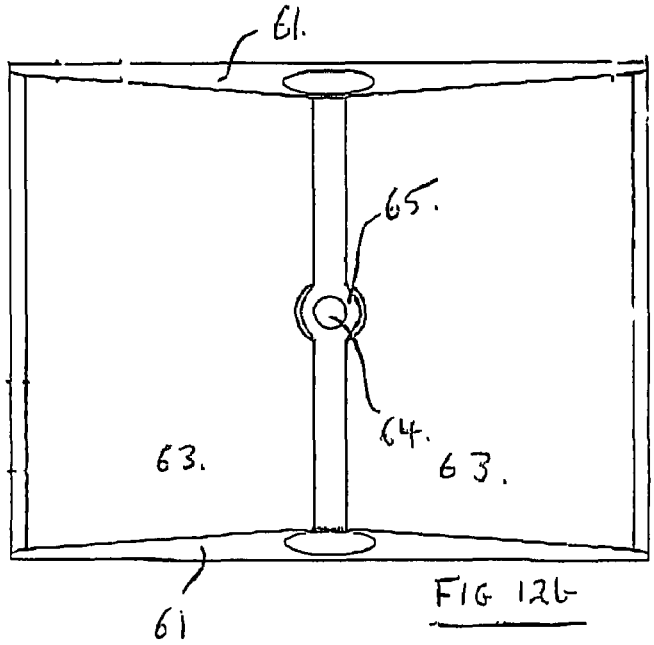
FIG 12b
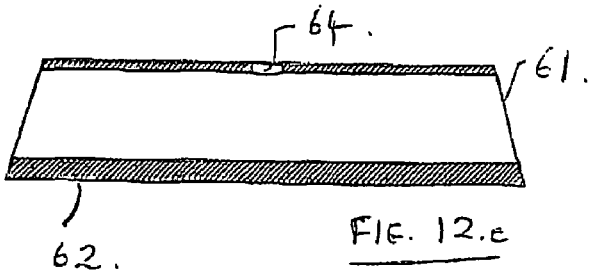
FIG. 12.c

FIG. 15.c

COUNTER-BALANCE WEIGHT FOR A MODULAR SAFETY RAIL

This application is a continuation in part of our U.S. patent application Ser. No. 10/287,480 filed on 5 Nov. 2002, now U.S. Pat. No. 6,942,199.

BACKGROUND OF THE INVENTION

This invention relates to a counter-balance weight for a modular type safety rail and in particular, though not exclusively, to a counter-balance weight and to a modular safety rail assembly suitable for use in providing free-standing roof edge protection.

Modular type safety rail systems are well know and typically comprise straight lengths of metal tubing interconnected by connectors of different types such that, for example, two, three or four way interconnections of horizontally and vertically extending tubes may be achieved.

Tubes serving as vertical posts of a safety rail, and to which horizontally extending tubes are connected, are supported by metal base plates of a rectangular shape and which, in use, rest on the surface of a roof. A flanged mounting socket typically is bolted to an upper surface of the plate, adjacent to one of the shorter edges of the rectangular shape, to provide location for the lower end of a vertical post.

The ability of the free-standing safety rail to avoid toppling when leant on may be achieved by a counter balance weight secured to the end of a spacer tube which, in use, extends horizontally over the roof surface and is secured rigidly to the base plate. This arrangement is particularly suitable if it is not possible or convenient to position a spacer bar to act as a stabiliser member which extends forwards, horizontally, in the direction of potential toppling.

If, however, space permits, a spacer tube may be arranged to extend forwards in the direction of potential toppling so as to act as a stabiliser bar. Optionally in that case the distal end of the stabiliser bar may be provided with a counter balance weight.

Commonly the counter-balance weight comprises a heavy metal plate and an end of a spacer tube is secured to the plate by being received firmly in a horizontally extending sleeve which is either bolted or welded to an upper surface of the plate.

An example of a typical known counter-balance weight is shown in perspective in FIG. 1. The counter-balance weight (10) comprises a rectangular shaped cast iron plate (11) which has welded (13) thereto a tubular sleeve (12) the bore (18) of which is dimensioned to receive the end of a spacer tube. The sleeve bore is provided with a pair of axially spaced screw threaded apertures (14) for receiving grub screws whereby the end of an horizontally extending spacer tube may be secured to the sleeve in known manner.

The aforedescribed construction as shown in FIG. 1 functions satisfactorily in use, but suffers the disadvantage of being costly to manufacture, by virtue for example of the need to weld the sleeve (12) to the plate (11), and of constituting a potential trip hazard, as well as not being as aesthetically pleasing as may be desirable for some installation locations. Additionally, if the sleeve (12) and plate (11) are pre-assembled by a manufacturer, the maximum possible ratio of weight to container space is not as high as would generally be preferred for reducing shipping costs of bulk supplies from a manufacturer to an importer or other distribution point.

SUMMARY OF THE INVENTION

The present invention seeks to provide means whereby at least some of the aforedescribed disadvantages of the conventional counter-balance weight may be mitigated or overcome.

In accordance with one aspect of the present invention a counter-balance weight for a modular safety rail comprises a solid body which defines a substantially planar major surface which, in use, is intended to rest on a support surface, said body defining a substantially linear through-bore for receiving an end of a spacer member, said through-bore extending continuously through the body in a direction substantially parallel with said substantially planar major surface of the body, said through-bore extending between a pair of end faces which, at least in part, are non-parallel end faces and said body further defining a screw-threaded aperture which extends through the body to intersect and communicate with said through-bore.

Preferably the counter-balance weight comprises substantially only said solid body.

The invention provides that as viewed in plan (i.e. perpendicular to said major surface) and or in a sideways direction perpendicular to the length of the through-bore, the body has a non-rectangular shape. That non-rectangular shape may be a shape profile which comprises a pair of substantially parallel rectilinear sides which extend parallel with the through-bore and two ends of which at least one, at least in part, extends inclined in contrast to perpendicularly relative to said parallel sides.

The at least one end region which at least in part is inclined may comprise an inclined portion which is rectilinear and or an inclined portion which is curved.

Preferably, but not necessarily, said at least one end is inclined in an inwards direction away from the substantially planar major surface such that, as considered in plan, the body reduces in size in a direction away from said substantially planar major surface.

Said screw-threaded aperture preferably is provided in a region of the body which is remote from said major surface. Thus the aperture may be positioned to communicate with the through-bore at a region of the through-bore which, in transverse section perpendicular to the length of the through-bore, is furthest from said major surface. The screw-threaded aperture preferably extends substantially perpendicular relative to said major surface.

The body, herein referred to also as a body member, may be of a substantially triangular shape as considered in transverse cross-section in a plane substantially perpendicular to the longitudinal axis of the through-bore. However, in one alternative the body may have an upper surface which is curved in said transverse cross-section, for example, of a part cylindrical or part elliptical shape.

The invention further provides a counter balance weight for a modular safety rail, said counter-balance weight comprising a body member of substantially triangular shape:—

- said triangular shape being substantially that of an isosceles triangle the apex angle of which is in the range 100° to 165°,
- said body having truncated edge regions which each lie spaced inwards from the respective lines of intersection of the shorter, inclined sides and the longer side of the triangular shape, and
- said screw-threaded aperture which extends through the body to intersect and communicate with said through-bore being positioned at an apex region of the body member between the two shorter, inclined sides.

An apex region may comprise a screw threaded boss aligned with and constituting a continuation of said screw-threaded aperture, said boss protruding outwards from the apex region and beyond the boundary of said triangular shape. Alternatively the apex region may be devoid of a protruding boss.

Preferably the maximum distance by which a boss protrudes away from an inclined side face, as considered in a direction perpendicular to the longer side of the triangular shape, is less than the distance between the side and longer faces of the triangular shape at said truncated edge regions, again as considered in a direction perpendicular to the longer side.

Irrespective of whether or not the body comprises a boss, it is taught by the present invention that the material of the body surrounding the screw-threaded aperture shall define a substantially planar end zone that lies perpendicular to the length of the aperture and extends from the axis of the aperture by a distance equal to at least the diameter of the aperture, preferably at least 1.5 and more preferably at least 2 times that diameter.

It is further preferred that the distance by which the edge regions lie spaced inwards from the respective lines of intersection of the shorter and longer sides of the isosceles triangle are each at least half of the maximum dimension of the outer surface of the boss region as considered in a direction parallel with the longer side of the triangular shape. Accordingly, when two of the counter-balance weights are laid side by side, with respective edge regions slightly spaced apart, a third counter-balance weight may be positioned in an inverted orientation, with the inclined faces thereof supported by neighbouring inclined faces of each of said two spaced weights, and with the protruding boss formation lying between the spaced edges. The boss formation of the inverted weight is then positioned spaced from a support surface on which the two spaced weights are positioned. Thus a plurality of the spaced weights may readily be stacked in a compact manner with high weight to space ratio, and without risk of damage to a protruding boss formation.

Although the invention contemplates that, for a body of triangular transverse section, the apex angle between the two inclined side faces of substantially equal size is in the range 100° to 165°, more preferably said apex angle is in the range 130° to 160°, with an angle of 150° being considered particularly preferable.

As considered in plan, in a plane containing the longer side of the triangular shape and parallel with the longitudinal axis of the through-bore, the larger face may be of a substantially rectangular shape. The body member may comprise a transverse end face which at least in part is substantially planar.

The ratio of width of the body member relative to the height thereof, for example as considered in directions parallel with and perpendicular to the longitudinal side of the triangular shape, preferably is greater than 3:1, more preferably greater than or equal to 4:1.

The height dimension preferably is less than twice the diameter of a through-bore of circular section, preferably less than or equal to 1.5 times the said diameter.

It is further preferred that the height is less than the sum of the diameter of a circular section through-bore and twice the thickness of the material between the through-bore and longer side of the triangular shape.

Preferably the truncated edge regions of the body member extend, at least in part, substantially perpendicular relative to the longer side of a said triangular shape as considered in said transverse section.

One suitable material for forming the body member is metal, eg a cast iron such as grey cast iron, though a malleable cast iron such as Blackheart cast iron may be employed. Casting is particularly suitable if a protruding boss formation is provided but alternatively, if no protruding boss formation is to be provided, the body member may be formed by extrusion, with the through-bore also being formed during extrusion.

The body member may be provided with a protective coating for example by galvanising in the case of a body member of cast iron; the screw-threaded aperture may be either provided with a protective coating or devoid of a coating.

The through-bore of each counter-balance weight may be of circular section whereby, in use, the counter-balance weight may readily be tilted about the longitudinal axis of the spacer member so as to rest uniformly on a support surface, such as a roof or ground surface, despite any localised inclination of the support surface.

The through bore may have a cross-sectional dimension which varies along the length of the bore and said dimension may be greater at at least one end region of the bore than at a central region between said end regions. The body may have a major surface which in use is intended to rest on a support surface and the dimension of the bore in a direction perpendicular to said major surface may be greater at an or each end region of the bore than at a central region of the bore. The bore may be of varying dimension as considered in a first of two mutually perpendicular longitudinal planes which each contain the major axis of the bore and in the second of said longitudinal planes may have a dimension, at at least one of said end regions, which is no greater than at said central region. In one preferred embodiment the bore has a circular section at a central region and an oval shape at each end.

The longitudinal axis of the through-bore preferably lies either mid-way between the major surface and a surface, such as an apex region surface, opposite said major surface, or closer to said opposite surface. That is, preferably it lies no closer to said major surface than a position half way between said major and opposite surfaces. Accordingly, it is envisaged that preferably the minimum wall thickness of the body between the through-bore and the major surface is at least equal to or greater than the minimum thickness between the through-bore and said opposite surface, namely the surface which is an upper surface in use of the counter-balance weight.

The present invention further provides a modular safety rail assembly comprising base connectors for supporting vertical posts of a safety rail and to which horizontally extending rail members are connected, and spacer members extending substantially horizontally from the base connectors, distal end of each said spacer member having secured thereto at least one counter-balance weight in accordance with the present invention. The or each counter-balance weight may be secured to a spacer member by means of a grub screw or like screw-threaded component fitted within the screw-threaded aperture of the counter-balance weight.

The assembly may comprise at least one of a counter-balance weight and a base connector of a type which permits a spacer member to be secured thereto in a range of positions inclined to a support face of the counter-balance weight or base connector whereby, in use, a spacer member may extend slightly inclined to a local surface region on which the weight or connector rests. An example of a suitable type of base connector is that described and claimed in our UK patent application GB 0221009.4.

BRIEF DESCRIPTION OF THE DRAWINGS

Embodiments of the present invention will now be described, by way of example only with reference to the accompanying diagrammatic drawings in which:—

FIGS. 12*a*, 12*b*, 12*c* show respectively perspective, plan and longitudinal section views of a counter balance weight in accordance with another embodiment of the invention;

FIGS. 15*a*, 15*b*, 15*c*, 15*d* show respectively perspective, plan, side and end views of another embodiment;

DETAILED DESCRIPTION OF THE PREFERRED EMBODIMENTS

A counter-balance weight (20) comprises a substantially solid body member of grey cast iron.

Figure 4:
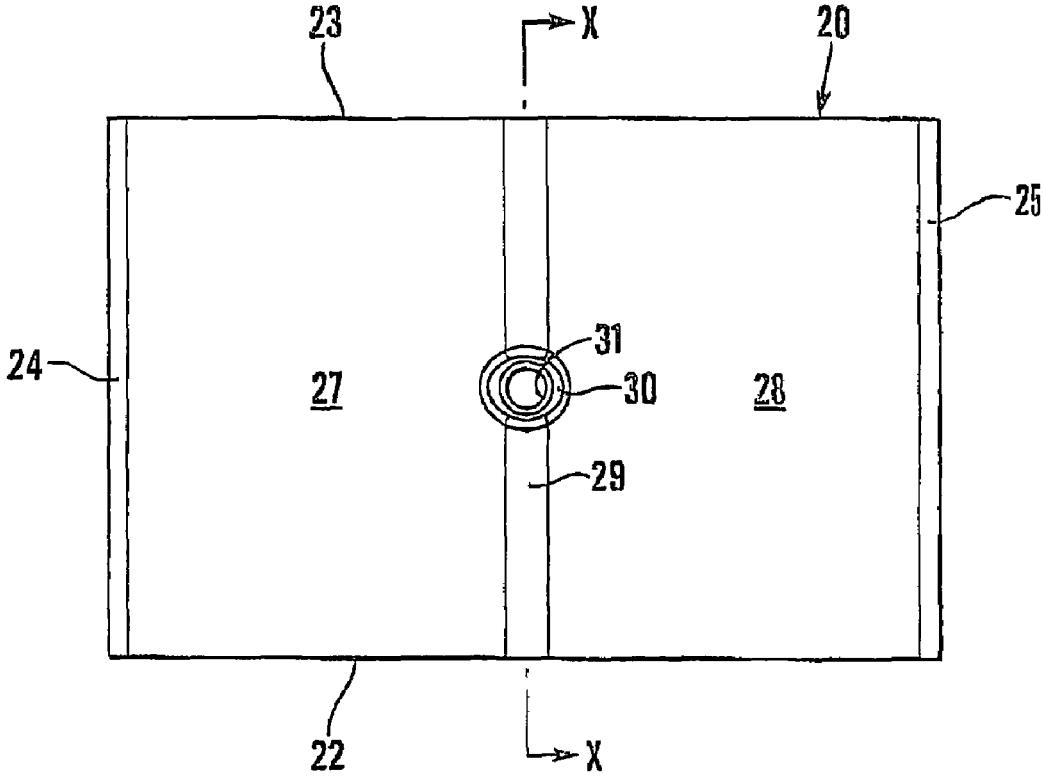
FIG. 4 is a plan view of the weight of FIG. 2.
Figure 5:
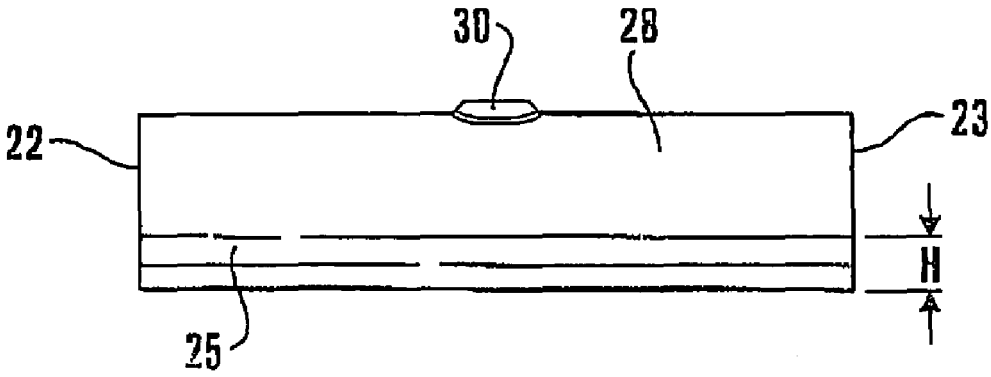
FIG. 5 is a side view of the weight of FIG. 2.
Figure 6:
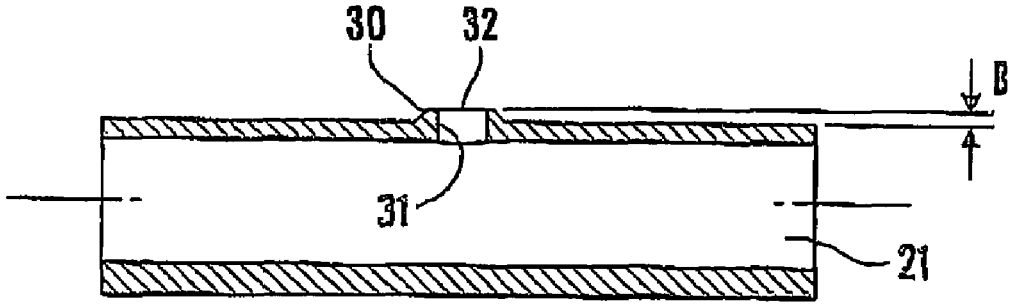
FIG. 6 is a longitudinal section on a line X-X of FIG. 4.

The weight is of a rectangular shape as viewed in plan, as shown in FIG. 4.

The body member is provided with a through-bore (21) which extends between transverse end faces (22, 23), each said end face being of a substantially triangular shape. The body member (20) is of a substantially symmetrical construction such that said triangular shape is that of an isosceles triangle, and the through-bore (21) is positioned mid-way between edge regions (24, 25).

The body member thus has a major face (26) which in use is intended to rest on a support surface such as that provided by a ground surface or roof surface, and a pair of shorter, relatively inclined upper surfaces (27, 28) which define therebetween an apex region (29). A boss (30) and screw threaded aperture (31) are provided mid-way along the length of the apex region, the boss protruding beyond said triangular shape. Aperture (31) extends in a direction perpendicular to said major face (26).

Figure 1:
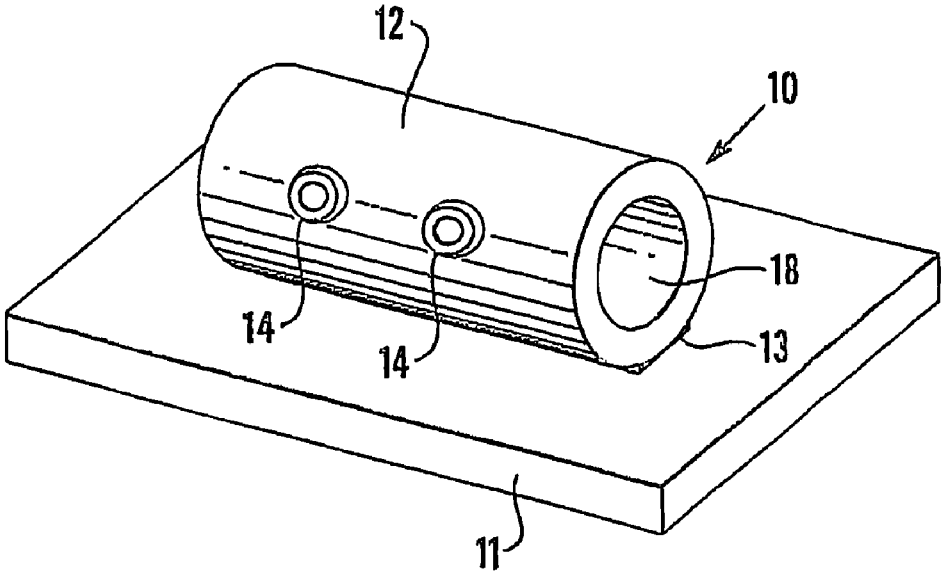
Fig. 1 (Prior Art)
FIG. 1 shows a perspective view of a conventional counter-balance weight.
Figure 2:
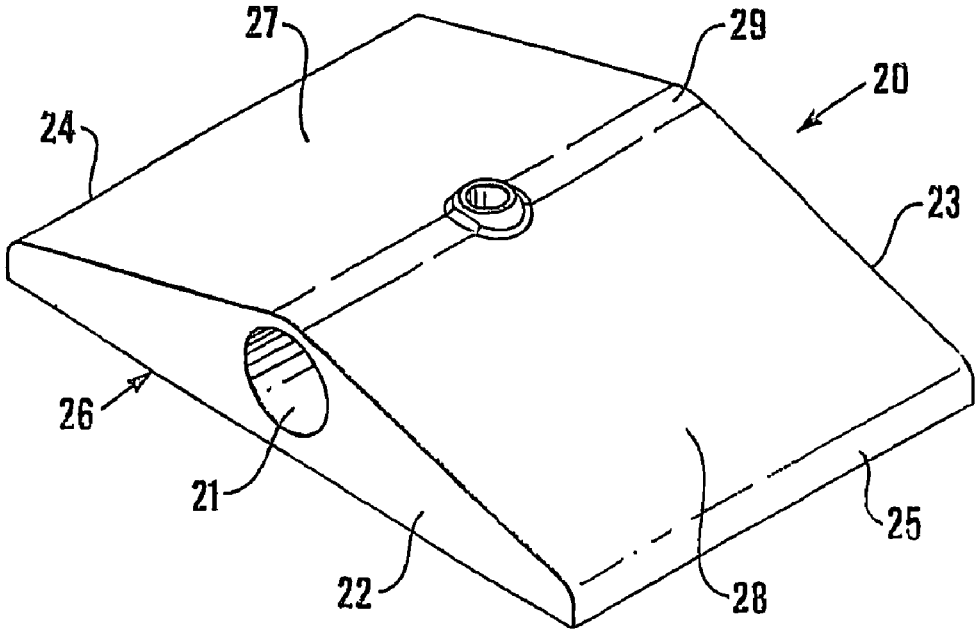
FIG. 2 shows in perspective a counter-balance weight in accordance with the present invention.
Figure 3:
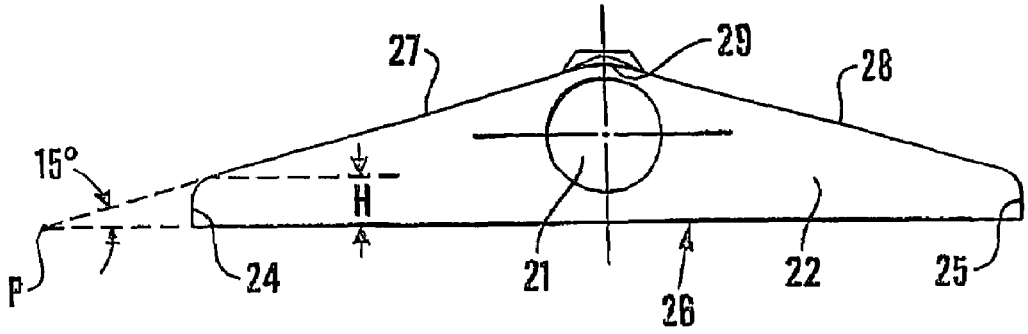
FIG. 3 shows a transverse end face of the weight of FIG. 2.

The volume of material of the body member in this embodiment is 40% of the volume of the smallest cuboid that can contain the body member, i.e. that cuboid having a volume equal to the height, width and length of the body as viewed in FIGS. 3 and 4.

In this embodiment of the invention the apex angle between the upper surfaces (27, 28) is 150°, the angle between each upper surface and the major surface (26) therefore being 15°.

The transverse end faces (22, 23) depart from a true triangular shape at the apex region, at which the body member is slightly curved. The end faces depart from a true isosceles triangle shape also at the edge regions (24, 25) which are truncated to lie inwards from the point of intersection of the longer and shorter sides of the shape of the end faces (22, 23), ie the intersection point (P) of the surfaces (26, 27) as shown in FIG. 3. The extent to which said edge regions (24, 25) lie inwards from the respective points of intersection is selected such that the height (H) of the edge regions, as considered in a direction perpendicular to the face (26), is more than the maximum height (B) by which the top surface (32) of the boss (30) extends above the apex region (29).

In this embodiment the ratio of the width of the body member, being the length of the longer side (26) as viewed in FIG. 3, relative to the height, being the spacing between the surfaces (26, 32), is 4.5:1.

The through-bore (21) of circular cross-sectional shape has a diameter which is in the order of two thirds of the height of the body (20) i.e. two thirds of the distance between the surfaces (26, 32). The longitudinal axis of the through-bore is positioned to lie substantially mid-way between said surface (26) and the upper surface (32) of the boss.

Figure 7:
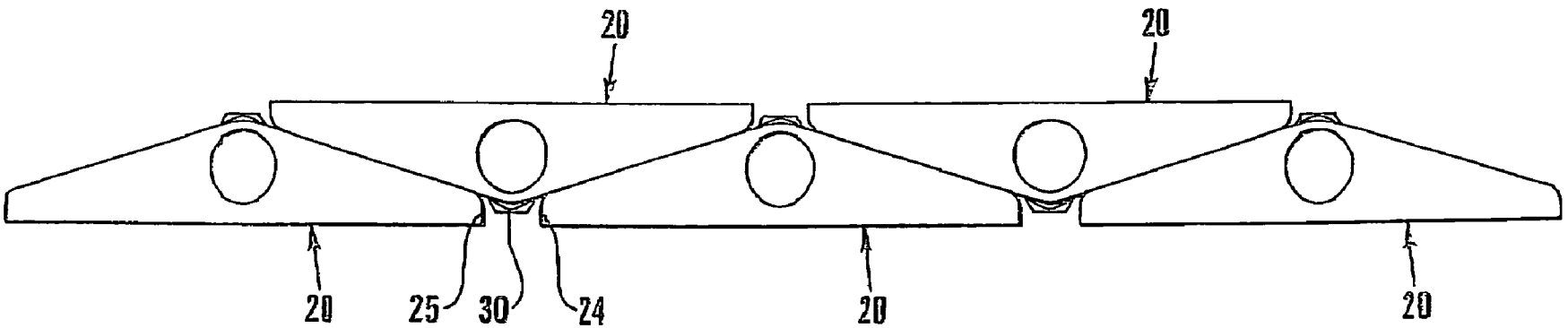
FIG. 7 is an end view of a plurality of the stacked weights.

FIG. 7 illustrates a plurality of weights arranged in a compact configuration for transport. Alternate weights are inverted, and both the inverted and non-inverted weights are slightly spaced apart such that the boss region (30) of one weight can lie between the spaced apart truncated edge regions (24, 25) of two other weights.

Figure 8:
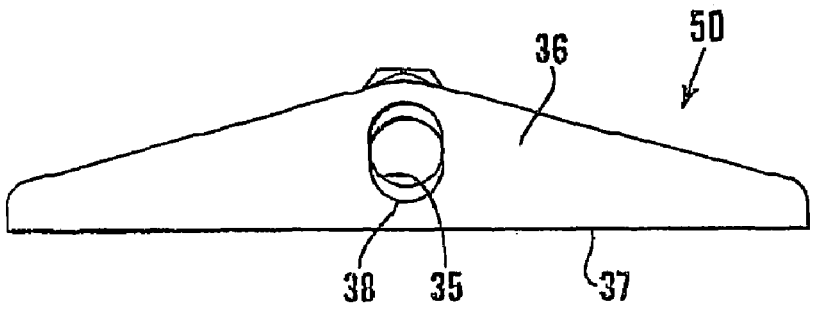
FIGS. 8 and 9 are longitudinal section and end views respectively of another embodiment of the invention.
Figure 9:
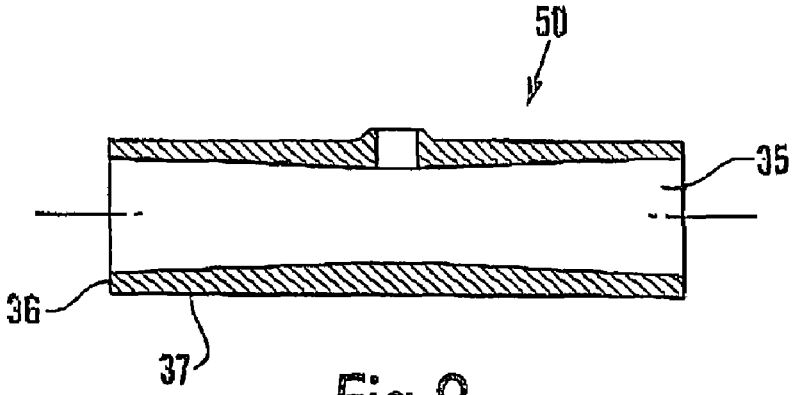

A counter-balance weight (50) in accordance with another embodiment of the invention is of a substantially similar construction to that shown in FIGS. 2 to 6, but differs in respect of the through-bore. The through-bore (35), see FIGS. 8 and 9, is of a circular cross-sectional shape at a central position mid-way between the ends (36) and opens outwards, with increasing dimension in a direction perpendicular to the major face (37) of the weight, to be of an oval shape (38) at each end. In consequence when a spacer tube of an outer diameter close to the diameter at the mid-length position of the bore is inserted in the bore, the tube can be tilted slightly relative to the plane of the major face (37) but the uniform width of the bore (as viewed in the transverse section of FIG. 8) ensures that the counter-balance weight remains aligned with the length of the tube.

Figure 10:
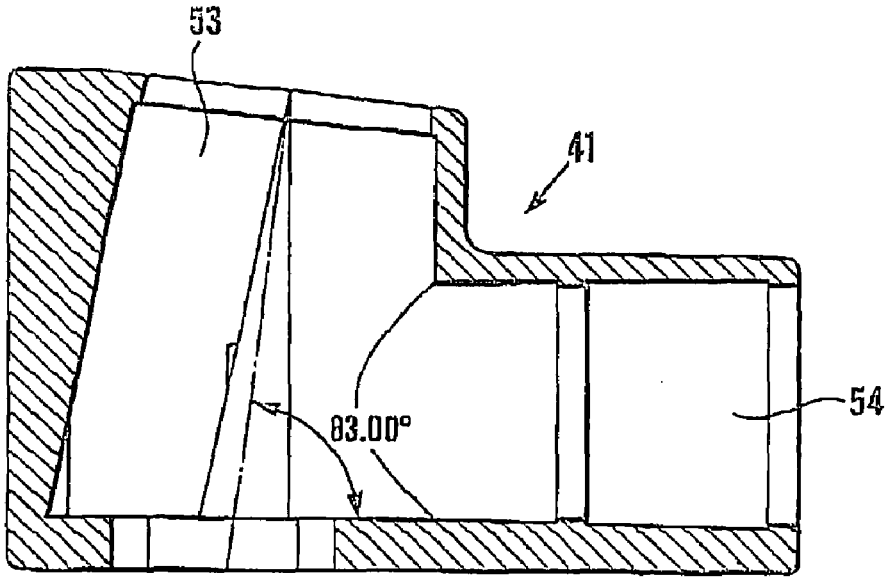
FIG. 10 is a sectional view of a base connector.

One suitable type of base unit for use in combination with the aforedescribed counter-balance weights is shown in cross-section in FIG. 10 and is of a kind the subject of our co-pending UK patent application GB 02 21009.4. The base unit (41) comprises a cast iron body having a first socket (53) to receive the lower end of a vertical post and a horizontal socket (54) to receive the end of a spacer bar. Each socket tapers slightly such that a post or spacer bar can be secured relative to the body of the base unit in any position within a prescribed angle range, in this case an angle range of plus or minus 5 degrees.

Figure 11:
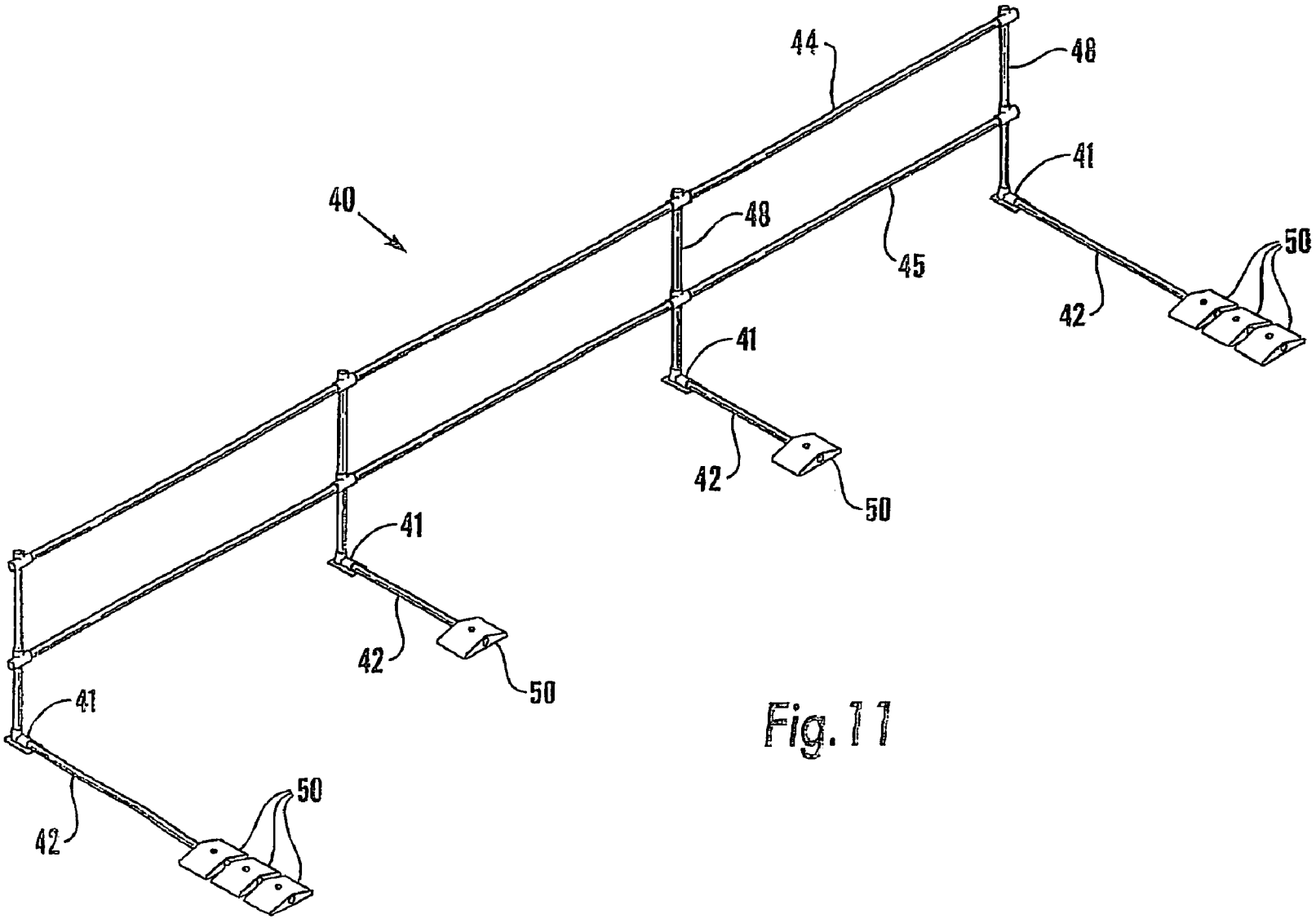
FIG. 11 shows a modular safety rail assembly incorporating counter-balance weights as described with reference to FIGS. 2 to 6, or 8 & 9.

FIG. 11 shows a short length of a safety rail installation (40) of a modular, free-standing type comprising base units (41), vertical posts (48), horizontal top and intermediate safety rails (44, 45), horizontal spacer bars (42) and counter-balance weights (50) secured to the distal end of each horizontal spacer bar (42). The counter-balance weights (50) are each of the type described above either with reference to FIGS. 2 to 6, or FIGS. 8 and 9. They are each secured to a spacer bar by means of a grub screw fitted within the screw threaded aperture of the boss (30) and tightened to bear firmly against an outer surface of the spacer tube. In this assembly the end spacer bars each have three weights (50) secured thereto, the weights being provided directly adjacent one another thereby to present substantially smooth and continuous upper inclined surfaces. The two intermediate spacer bars each have only one weight (50) secured thereto.

Other possible shapes of counter balance weights are now described.

FIGS. 12*a*, 12*b* and 12*c* show a weight 60 having end faces 61 which are each planar but lie in a non-parallel manner, inclined inwards away from the major, base surface 62, in this case at an angle in the range 55° to 80°. That angle is greater than the angle by which the upper faces 63 lie inclined relative to the surface 62. As best seen from FIG. 12*c*, when considered in a sideways direction the body has a non-rectangular profile. Other features of the weight 60 are similar to those of the weight of FIG. 2, except that there is no protruding boss 30. Instead the screw-threaded aperture 64 is surrounded by a flat land 65 that extends outwards from the axis of the aperture by a distance equal to the diameter of the aperture.

Figure 13A:
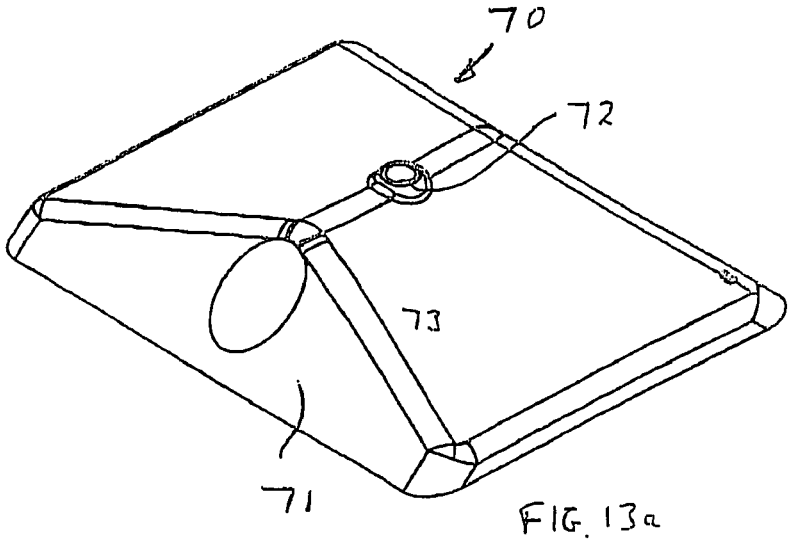
FIGS. 13 and 14 each set forth views similar to those of FIG. 12 of two further embodiments.
Figure 13B:
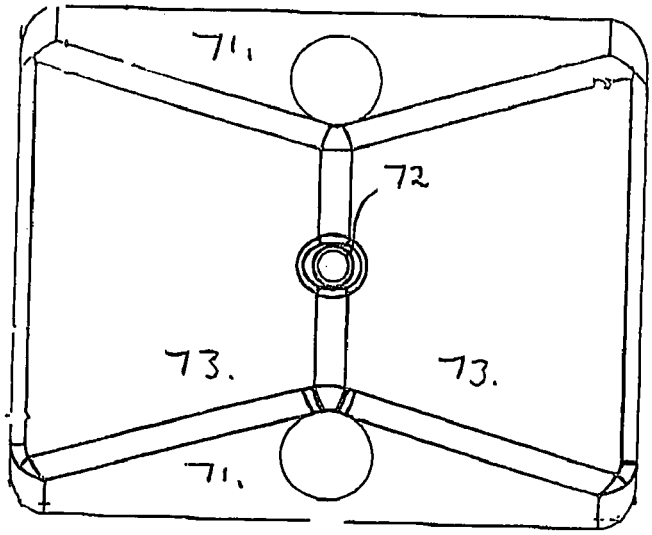
Figure 13C:
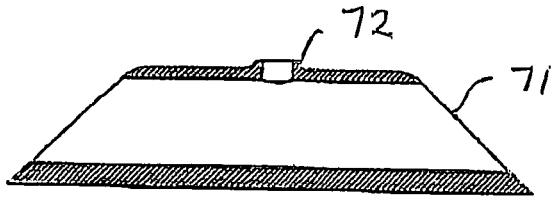

FIGS. 13*a*, 13*b*, 13*c* show a weight 70 which is a variation of that of FIG. 12. The end faces 71 lie at a lower inclination, of 45°, though even lower angles, down to that of the inclination of the upper faces 73 is envisaged. The weight 70 differs also in being provided with a protruding boss 72.

Figure 14A:
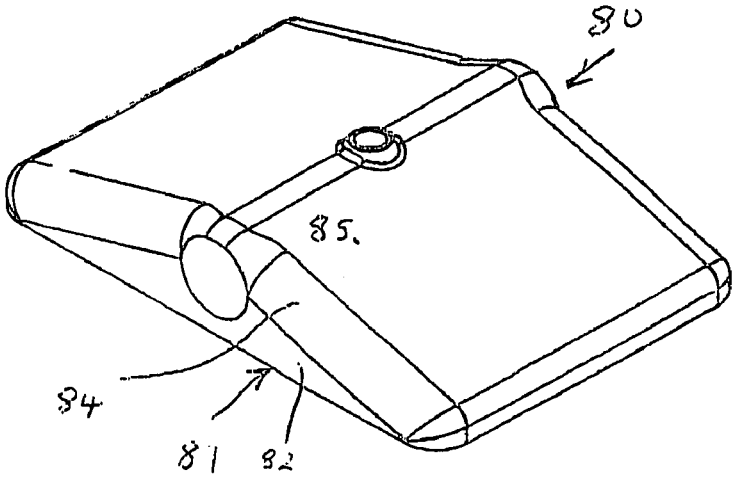
Figure 14B:
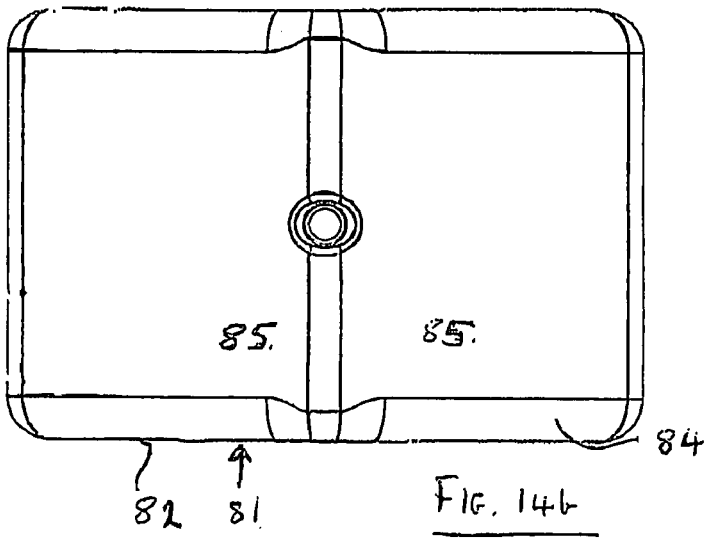
Figure 14C:
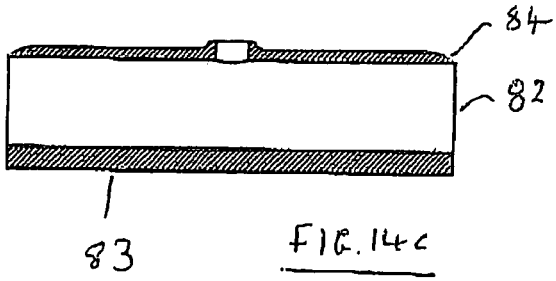

FIGS. 14*a*, 14*b*, 14*c* show a weight 80 which has end faces 81 that differ from those of FIG. 13. The faces 81 each comprise in part a planar section 82 that extends perpendicularly from the base surface 83, and a curved section 84 which leads, in an inwards direction, to the upper inclined surfaces 85.

Figure 15A:
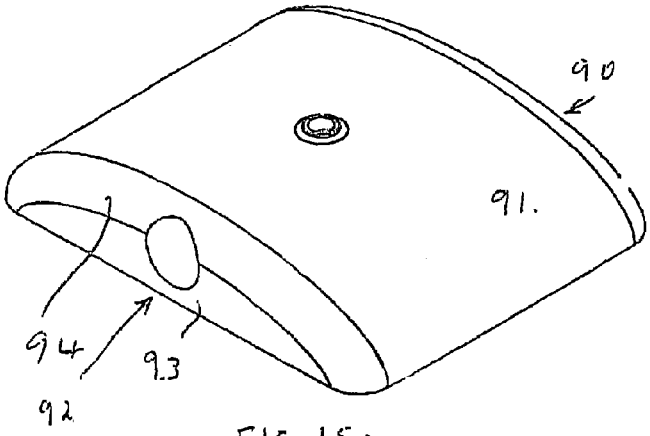
Figure 15B:
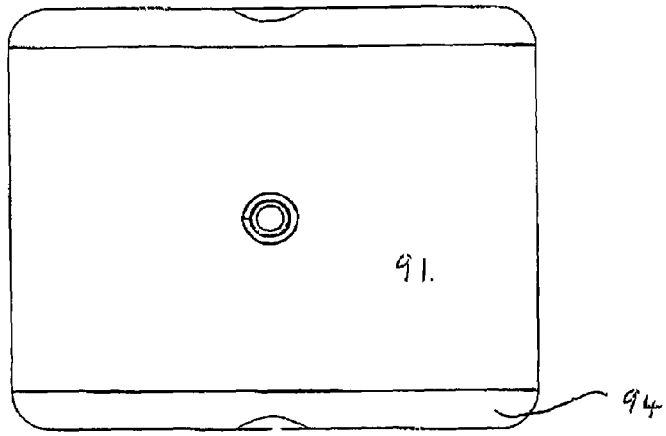
Figure 15D:
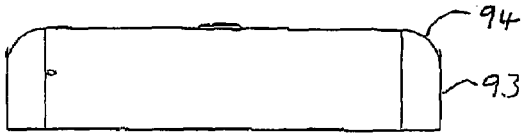
Figure 15D:
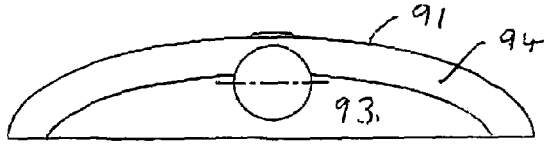
Figure 16A:
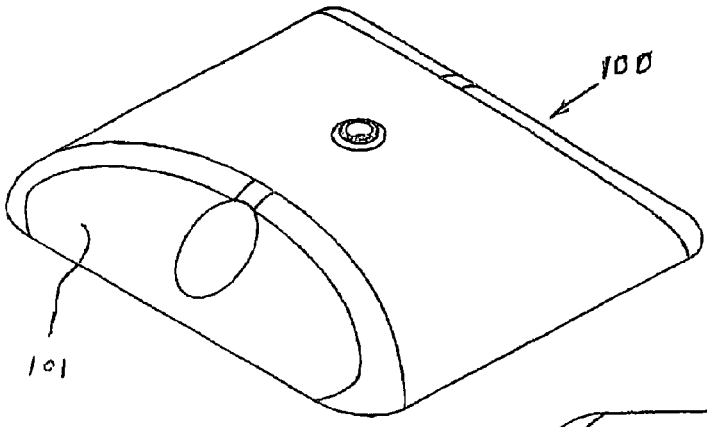
FIG. 16 sets forth views similar to those of FIG. 15 of yet another embodiment.
Figure 16B:
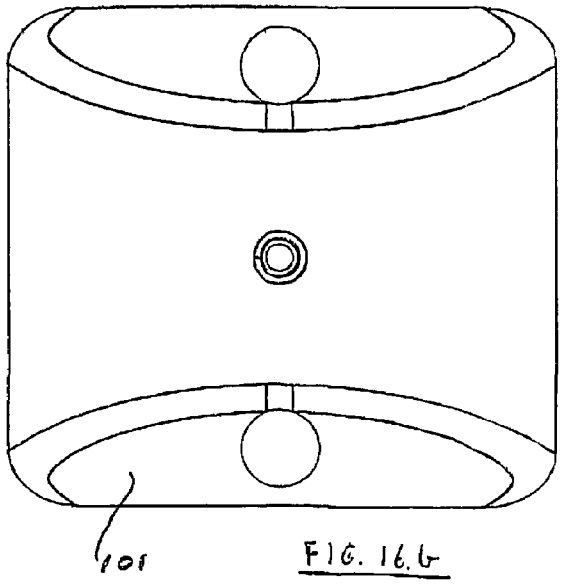
Figure 16C:
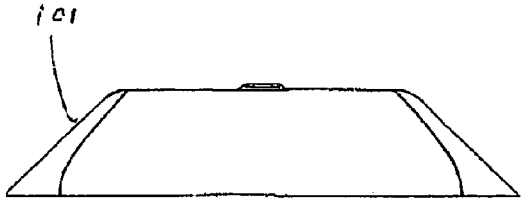
Figure 16D:
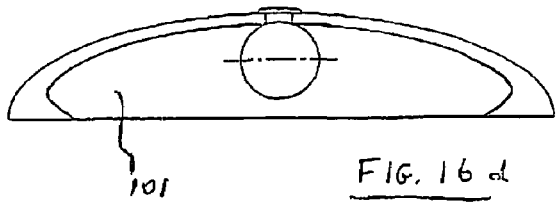
Figure 17A:
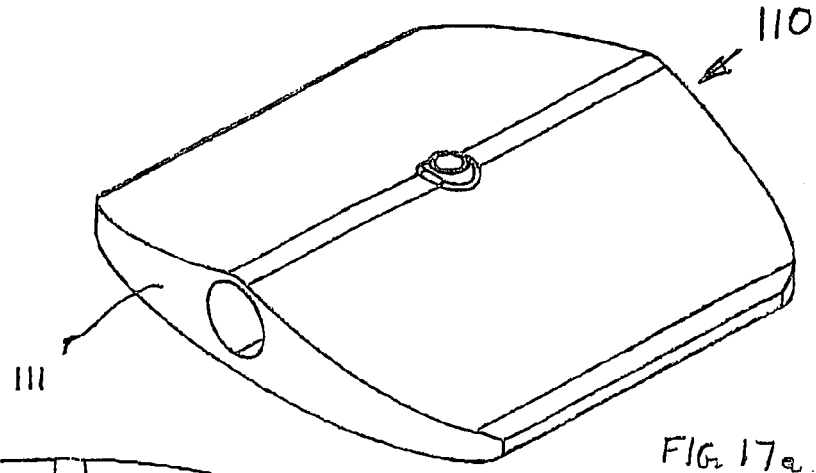
FIGS. 17*a*, 17*b*, 17*c*, 17*d* shows respectively perspective, plan, side and end views of a further embodiment.
Figure 17B:
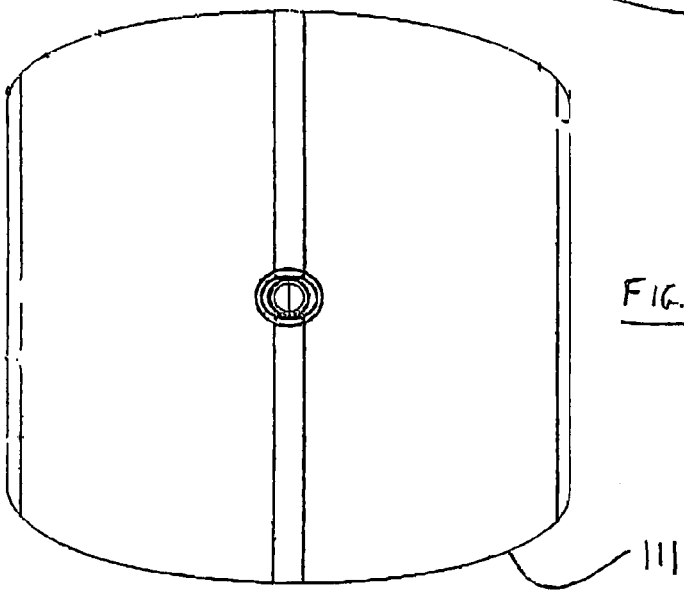
Figure 17C:
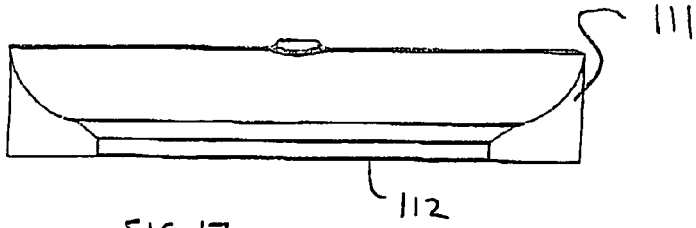
Figure 17D:
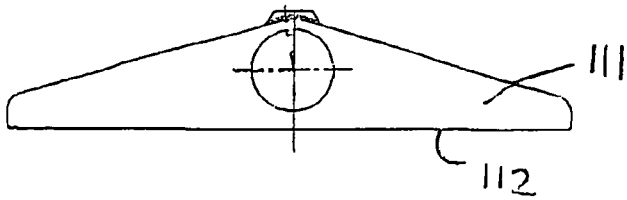

FIGS. 15*a*, 15*b*, 15*c*, 15*d* show a weight 90 which is similar to that of FIG. 14 but has an upper surface 91 of curved shape, being substantially part elliptical as viewed in FIG. 15*d*. Each end face 92 comprises planar and curved portions 93, 94 corresponding substantially with the portions 82, 84 of the weight 80 of FIG. 14.

FIGS. 16*a*, 16*b*, 16*c*, 16*d* show a weight 100 which is similar to that of FIG. 12, but has planar end face portions 101 which lie at a greater angle of inclination. That angle preferably is in the range 30° to 60°, and is approximately 45° in the illustrated embodiment.

The embodiments of FIGS. 2 to 9 and 12 to 16 each have footprints of a substantially rectangular shape. In the embodiment illustrated in FIGS. 17*a*, 17*b*, 17*c*, 17*d* a weight 110 has a footprint which is non rectangular, as best seen from 17*b*. The two end faces 111 each extend perpendicularly relative to the base 112, but are convexly curved, being curved in a substantially elliptical shape. Other shape features are substantially similar to those of the weight of FIG. 2.

The invention claimed is:

1. A modular safety rail assembly, comprising:

plural base connectors for supporting vertical posts of a safety rail and to which horizontally extending rail members are connected;

plural spacer members extending substantially horizontally from the plural base connectors; and at least one counter-balance weight secured to a distal end of each of said plural spacer members remote from said plural base connectors, said counter-balance weight comprising substantially only a solid body which defines a substantially planar major surface which, in use, is intended to rest on a support surface, said body defining a through-bore for receiving an end of one of said spacer members, said through-bore extending continuously through the body in a direction substantially parallel with said substantially planar major surface of the body, said through-bore extending between a pair of end faces which, at least in part, are non-parallel end faces and said body further defining a screw-threaded aperture which extends through the body to intersect and communicate with said through-bore.

2. The modular safety rail assembly according to claim 1, wherein said solid body is of a compact shape which is of a substantially triangular shape as considered in transverse cross-section in a plane substantially perpendicular to the longitudinal axis of the through-bore, and said through-bore is substantially linear.

3. The modular safety rail assembly according to claim 2, wherein the longitudinal axis of the through-bore lies no closer to said major surface than half of the distance between said major surface and a surface opposite said major surface.

4. The modular safety rail assembly according to claim 2, wherein said screw-threaded aperture is provided in a region of the body which is remote from said major surface, and said screw-threaded aperture extends substantially perpendicular relative to said major surface.

5. The modular safety rail assembly according to claim 2, wherein the through-bore of the counter-balance weight is of circular section whereby, in use with a circular section member extending through said bore, the counter-balance weight may be tilted readily about the longitudinal axis of the spacer member so as to rest uniformly on a support surface despite any localised inclination of the support surface.

6. The modular safety rail assembly according to claim 2, wherein a cross-sectional dimension of the bore varies along the length of the bore.

7. The modular safety rail assembly according to claim 6, wherein said cross sectional dimension is greater at least at one end region of the bore than at a central region between said end regions of the bore.

8. The modular safety rail assembly according to claim 7, wherein the dimension of the bore in a direction perpendicular to said major surface is greater at an or each end region of the bore than at the central region of the bore.

9. The modular safety rail assembly according to claim 7, wherein the bore is of varying dimension as considered in a first of two mutually perpendicular longitudinal planes which each contain the major axis of the bore and in the second of said longitudinal planes has a dimension, at at least one of said end regions, which is no greater than at said central region.

10. The modular safety rail assembly according to claim 2, wherein the length of the body at a side edge region of the body, as considered in a direction parallel with the length of the through-bore, is less than the length of said substantially planar major surface at a position substantially midway between side edge regions.

11. The modular safety rail assembly according to claim 2, wherein the length of the body at an upper surface region of the body which is furthest away from said substantially planar major surface is less than the length of said substantially planar major surface at a position substantially mid-way between said edge regions.

12. The modular safety rail assembly according to claim 2, wherein as considered in a cross-sectional plane which is substantially parallel with the length direction of the through-bore and is perpendicular to said major surface, the body comprises at least one end region which at least in part lies inclined relative to a plane which is perpendicular to said length direction of the through-bore.

13. The modular safety rail assembly according to claim 12, wherein said at least one end region comprises an inclined portion which is rectilinear.

14. The modular safety rail assembly according to claim 12, wherein said at least one end region comprises an inclined portion which is curved.

15. The modular safety rail assembly according to claim 2, wherein as considered in a plane parallel with said substantially planar major surface, the body comprises at least one end region which at least in part lies inclined relative to a plane which is perpendicular to said length direction of the through-bore.

16. The modular safety rail assembly according to claim 15, wherein said at least one end region comprises an inclined portion which is rectilinear.

17. The modular safety rail assembly according to claim 15, wherein said at least one end region comprises an inclined portion which is curved.

18. The modular safety rail assembly according to claim 2, wherein said triangular shape is a closed triangle with one side of said triangle being said planar major surface.

19. The modular safety rail assembly according to claim 1, wherein said counter balance weight comprises substantially only said solid body and said solid body is of a compact shape wherein the volume of the material of said body is at least 20% of the volume of the smallest cuboid which is able to contain said body, the body being of a substantially triangular shape as considered in transverse cross-section in a plane substantially perpendicular to the longitudinal axis of the through-bore;

said triangular shape being substantially that of an isosceles triangle the apex angle of which is in the range 100° to 165°;

said body having truncated edge regions which each lie spaced inwards from the respective lines of intersection of the shorter, inclined sides and the longer side of the triangular shape, and said screw-threaded aperture which extends through the body to intersect and communicate with said through-bore being positioned at an apex region of the body member between the two shorter, inclined sides.

20. The modular safety rail assembly according to claim 19, wherein the distance by which the edge regions lie spaced inwards from the respective lines of intersection of the shorter and longer sides of the isosceles triangle are each at least half of the maximum dimension of the outer surface of the boss region as considered in a direction parallel with the longer side of the triangular shape.

21. The modular safety rail assembly according to claim 19, wherein the apex angle between the two inclined side faces of substantially equal size is in the range 130° to 160°.

22. The modular safety rail assembly according to claim 19, wherein the ratio of width of the body member relative to the height thereof, as considered in directions parallel with and perpendicular to the longitudinal side of the triangular shape, is greater than 3:1.

23. The modular safety rail assembly according to claim 19, wherein the through-bore is of circular section and the height dimension, in a direction perpendicular to said longer side, is less than twice the diameter of the through-bore.

24. The modular safety rail assembly according to claim 19, wherein the through-bore is of circular section and the height dimension, in a direction perpendicular to said longer side, is less than the sum of the diameter of said through-bore and twice the thickness of the material between the through-bore and longer side of the triangular shape.

25. The modular safety rail assembly according to claims 19, wherein the truncated edge regions of the body extend, at least in part, substantially perpendicular relative to the longer side of said triangular shape as considered in said transverse section.

26. The modular safety rail assembly according to claim 19, wherein the apex region comprises a screw threaded boss aligned with and constituting a continuation of said screw-threaded aperture, and wherein said boss protrudes outwards from the apex region and beyond the boundary of said triangular shape.

27. The modular safety rail assembly according to claim 26, wherein the maximum distance by which the boss protrudes away from an inclined side face, as considered in a direction perpendicular to the longer side of the triangular shape, is less than the distance between the side and longer faces of the triangular shape at said truncated edge regions, again as considered in a direction perpendicular to the longer side.

28. A modular safety rail assembly according to claim 1, wherein at least one of the base connector and counterbalance weight is of a type which permits an end of the spacer member to be secured thereto within a range of positions inclined to a support face of the connector or weight whereby, in use, the spacer member may extend slightly inclined to a local surface region on which the base connector or counter balance weight rests.

29. The modular safety rail assembly according to claim 1, wherein the body has a non-rectangular footprint shape as viewed in plan in a direction perpendicular to said substantially planar major surface.

30. The modular safety rail assembly according to claim 1, wherein the body has a non-rectangular shape as viewed in a sideways direction perpendicular to the length of the through-bore and parallel with said substantially planar major surface.

* * * * *